US011453216B2

(12) United States Patent
Hayashi et al.

(10) Patent No.: US 11,453,216 B2
(45) Date of Patent: Sep. 27, 2022

(54) LIQUID EJECTION HEAD

(71) Applicant: Brother Kogyo Kabushiki Kaisha, Nagoya (JP)

(72) Inventors: Hideki Hayashi, Nagoya (JP); Taisuke Mizuno, Yokkaichi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/898,402

(22) Filed: Jun. 10, 2020

(65) Prior Publication Data

US 2020/0384773 A1 Dec. 10, 2020

(30) Foreign Application Priority Data

Jun. 10, 2019 (JP) ..... JP2019-107976

(51) Int. Cl.
*B41J 2/14* (2006.01)
*B41J 2/055* (2006.01)

(52) U.S. Cl.
CPC ..... *B41J 2/1408* (2013.01); *B41J 2/1433* (2013.01); *B41J 2/14233* (2013.01); *B41J 2/055* (2013.01); *B41J 2002/14241* (2013.01); *B41J 2002/14306* (2013.01); *B41J 2002/14419* (2013.01); *B41J 2202/08* (2013.01)

(58) Field of Classification Search
CPC ..... B41J 2002/14241; B41J 2/14233
See application file for complete search history.

(56) References Cited

U.S. PATENT DOCUMENTS

| | | | | |
|---|---|---|---|---|
| 10,093,102 | B2 | 10/2018 | Kimura | |
| 2006/0017786 | A1* | 1/2006 | Takahashi | B41J 2/055 347/71 |
| 2014/0292936 | A1* | 10/2014 | Kinoshita | B41J 2/055 347/50 |
| 2016/0009085 | A1* | 1/2016 | Chen | B41J 2/14072 347/44 |
| 2016/0229186 | A1* | 8/2016 | Kanegae | B41J 2/055 |
| 2016/0297202 | A1* | 10/2016 | Akahane | B41J 2/1623 |
| 2017/0066247 | A1* | 3/2017 | Mizuno | B41J 2/055 |
| 2018/0086084 | A1 | 3/2018 | Kimura | |
| 2018/0264807 | A1* | 9/2018 | Ito | B41J 2/04563 |
| 2018/0265353 | A1* | 9/2018 | Chen | B41J 2/1603 |
| 2018/0290446 | A1* | 10/2018 | Kohda | B41J 2/14274 |

FOREIGN PATENT DOCUMENTS

JP 2018-51768 A 4/2018

* cited by examiner

*Primary Examiner* — Shelby L Fidler
(74) *Attorney, Agent, or Firm* — Banner & Witcoff, Ltd.

(57) ABSTRACT

A liquid ejection head includes a nozzle surface having a plurality of nozzles, a channel structure stacked on the nozzle surface in a stacking direction, and a supply channel structure formed of a material having a lower thermal conductivity than a material of the channel structure. The channel structure has a liquid ejection channel communicating with the nozzles. The supply channel structure has a supply channel communicating with the liquid ejection channel. The supply channel structure has a covering portion covering at least a portion of an end surface on a side of the channel structure in a width direction orthogonal to the stacking direction.

21 Claims, 9 Drawing Sheets

LIQUID EJECTION HEAD

CROSS-REFERENCE TO RELATED APPLICATION

This application claims priority from Japanese Patent Application No. 2019-107976 filed on Jun. 10, 2019, the content of which is incorporated herein by reference in its entirety.

TECHNICAL FIELD

Aspects of the disclosure relate to a liquid ejection head included in a liquid ejection apparatus configured to eject liquid such as ink.

BACKGROUND

As a liquid ejection apparatus that ejects liquid such as ink, an inkjet printer is known. The liquid ejection apparatus ejects liquid from its liquid ejection head toward a medium such as a recording sheet to form an image on the medium. A known liquid ejection head includes a supply channel structure through which liquid passes, and a heater that heats the supply channel structure.

The liquid ejection head includes nozzles, a channel structure formed with liquid ejection channels that guide liquid to the nozzles, the supply channel structure formed with supply channels that supply liquid to the liquid ejection channels, and the heater that heats the supply channel structure. In the liquid ejection head, the supply channel structure is formed of a synthetic resin, the channel structure is formed of an inorganic material, for example, silicon, whose linear expansion coefficient is less than that of the synthetic resin. The channel structure and the supply channel structure are joined together by a thermoset adhesive. In the liquid ejection head, heating the supply channel structure using the heater enables the supply channel structure to be expanded, thereby curing the thermoset adhesive and thus reducing residual stress arising due to a difference in the amounts of contraction of the channel structure and the supply channel structure.

For a high viscosity liquid, the liquid requires heating to a temperature (for example, 40 degrees), which is slightly greater than room temperature, at which the liquid attains a desired viscosity to be ejected from nozzles appropriately and effectively. The liquid ejection head uses the heater to heat the supply channel structure, thereby heating liquid.

SUMMARY

In the liquid ejection head, microfabrication is used to form the channel structure with the liquid ejection channels. The channel structure is thus formed of silicon, which can be micro-fabricated. Silicon is, however, higher in thermal conductivity than the synthetic resin forming the supply channel structure. While liquid supplied from the supply channels flows in the liquid ejection channels, its temperature is lowered by heat dissipation. Due to the heat dissipation, liquid ejection from nozzles may occasionally become inappropriate and inefficient.

Aspects of the disclosure provide a liquid ejection head configured to reduce heat dissipation from a liquid ejection channel.

According to one or more aspects of the disclosure, a liquid ejection head includes a nozzle surface having a plurality of nozzles, a channel structure stacked on the nozzle surface in a stacking direction, and a supply channel structure formed of a material having a lower thermal conductivity than a material of the channel structure. The channel structure has a liquid ejection channel communicating with the nozzles. The supply channel structure has a supply channel communicating with the liquid ejection channel. The supply channel structure has a covering portion covering at least a portion of an end surface on a side of the channel structure in a width direction orthogonal to the stacking direction.

DETAILED DESCRIPTION

First Embodiment

A liquid ejection apparatus 1 according to a first embodiment and a liquid ejection head 13 included in the liquid ejection apparatus 1 will be described with reference to the drawings.

Structure of Liquid Ejection Apparatus

Figure 1:
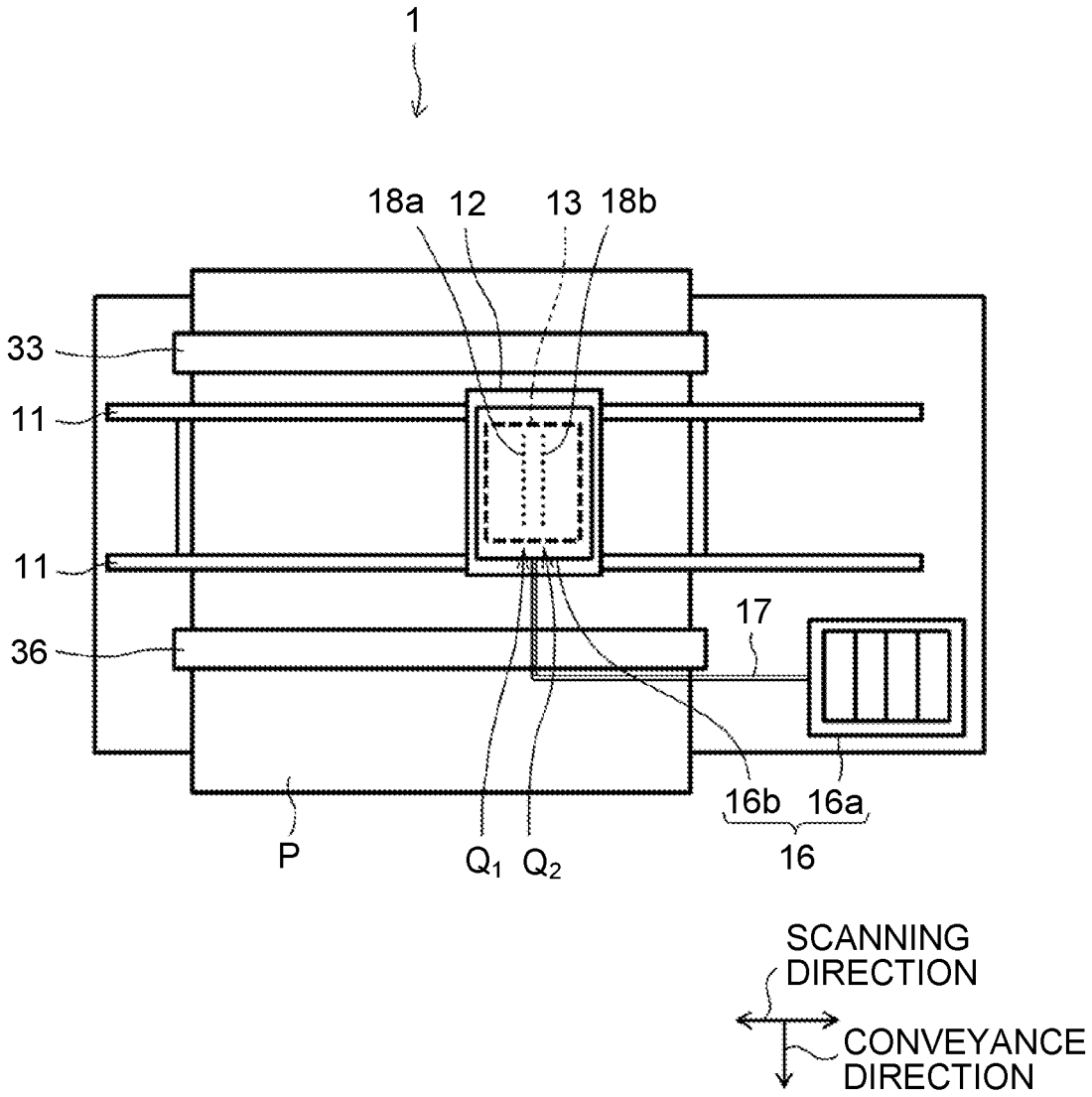
FIG. 1 is a schematic plan view of a liquid ejection apparatus according to a first embodiment, when viewed from the top.

FIG. 1 is a schematic plan view of a liquid ejection apparatus 1 according to the first embodiment, when viewed from the top. The liquid ejection apparatus 1 includes a carriage 12, guide members 11, and an endless belt (not shown), which collectively function as a head scanning mechanism to move the liquid ejection head 13 reciprocally. The guide members 11 are two parallel rods spaced apart from each other in a conveyance direction and extending in a scanning direction orthogonal to the conveyance direction. The carriage 12 is slidably mounted on the guide members 11. The head scanning mechanism moves the liquid ejection head 13 reciprocally in the scanning direction.

Figure 2:
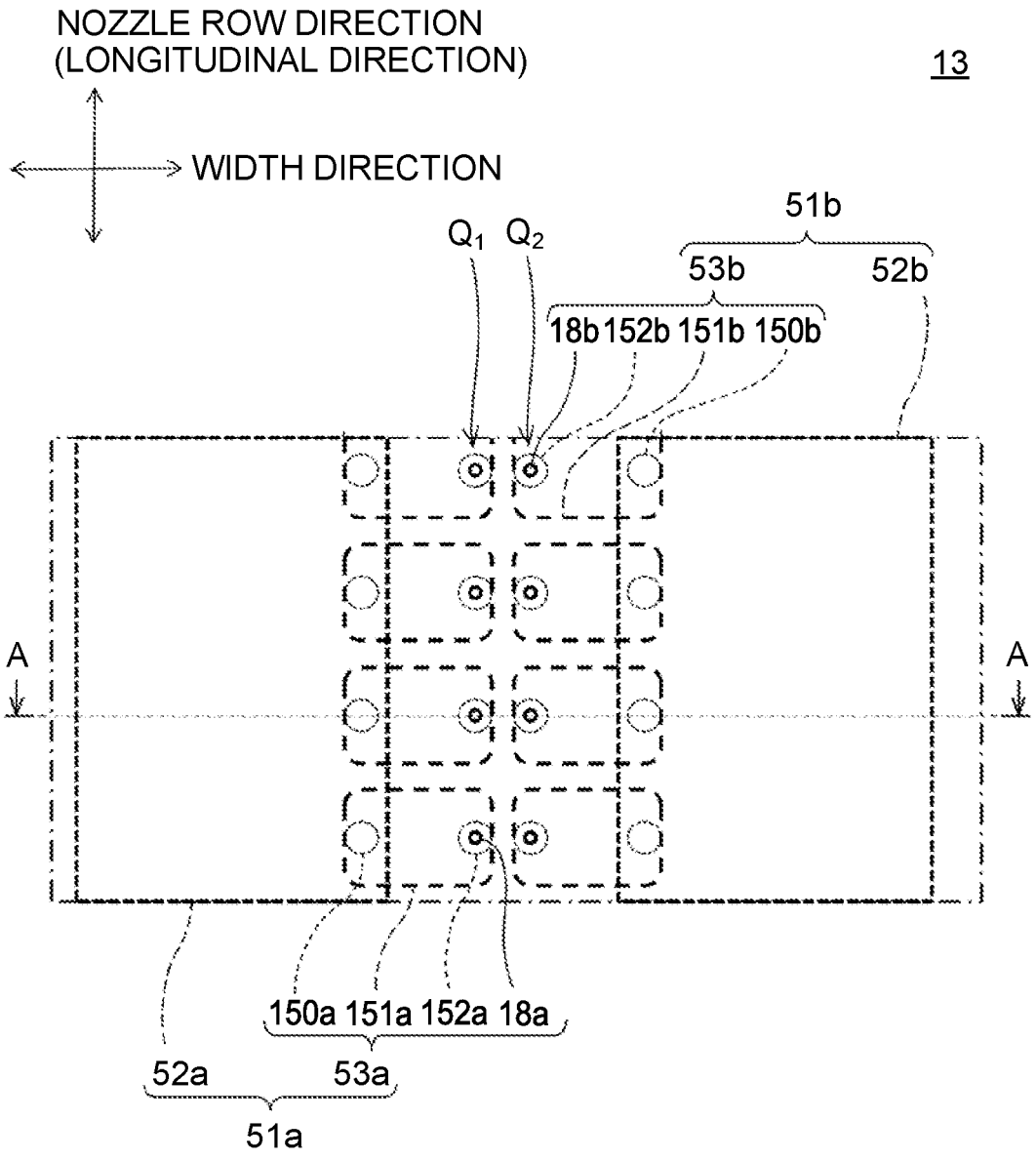
FIG. 2 is a partial cross-sectional view of a liquid ejection head of FIG. 1 when viewed from a nozzle surface.

The liquid ejection head 13 has its lower surface facing a sheet P. The lower surface is a nozzle surface 19 (FIG. 3) having a plurality of nozzles 18 corresponding to a plurality of individual channels 53. Although described later in details, a plurality of first individual channels 53*a* are provided for a first manifold 52*a* (FIG. 2). The first individual channels 53*a* correspond to first nozzles 18*a* that form a first nozzle row Q1. A plurality of second individual channels 53*b* are provided for a second manifold 52*b* (FIG. 2). The second individual channels 53*b* correspond to second nozzles 18*b* that form a second nozzle row Q2. In FIG.

1, the first nozzle row Q1 and the second nozzle row Q2 extend in the conveyance direction. The first nozzles 18*a* and the second nozzles 18*b* may be hereinafter referred just to as a nozzle or nozzles 18, the first manifold 52*a* and the second manifold 52*b* may be hereinafter referred just to as a manifold or manifolds 52, the first individual channels 53*a* and the second individual channels 53*b* may be hereinafter referred just to as an individual channel or channels 53, the first nozzle row Q1 and the second nozzle row Q2 may be hereinafter referred just to as a nozzle row or rows Q, unless description requires a distinction therebetween.

The liquid ejection head 13 is connected to tanks 16. Each of the tanks 16 includes a sub tank 16*b* disposed on the liquid ejection head 13 and a storing tank 16*a* connected via a corresponding tube 17 to the sub tank 16*b*. The sub tank 16*b* and the storing tank 16*a* store liquid. The tanks 16 are provided in correspondence with the number of colors of liquid to be ejected from nozzles 18 of the individual channels. In this example, four ink tanks 16 are provided, each storing liquid in a corresponding one of four colors, black, yellow, cyan, and magenta. The liquid ejection head 13 thus ejects various colors of liquid.

The liquid ejection apparatus 1 forms (or records) an image all over the page of a sheet P by repeating scanning of the carriage 12 and conveying of the sheet P. The carriage 12 is movable in the scanning direction beyond a range in which a sheet P is conveyed. One side of the liquid ejection apparatus 1 in the scanning direction includes a store position (not shown) where the liquid ejection head 13 is retained in store. When the power is turned off, the liquid ejection head 13 is moved to the store position and the nozzle surface 19 is covered with a cap. The other side of the liquid ejection apparatus 1 in the scanning direction includes a maintenance port (not shown) for the liquid ejection head 13. Here, maintenance including flushing and purging is carried out on the liquid ejection head 13.

The liquid ejection head 13 is described above using an example as applied to, but not limited to, a serial head. The liquid ejection head 13 may be applied to a line head.

A controller includes a central processing unit (CPU), read only memory (ROM), a random access memory (ROM), and electrically erasable programmable read-only memory (EEPROM). The controller is connected to a motor driver IC (not shown) for driving a conveyance motor (not shown) to rotate a conveyor roller 33 and an ejection roller 36 in a sheet conveyance mechanism that conveys a sheet P. The controller is also connected to a motor driver IC (not shown) for driving a carriage motor (not shown) to reciprocally move the carriage 12 in the scanning direction in the head scanning mechanism. The controller is further connected to a head driver IC (not shown) for driving piezoelectric elements 71 (FIG. 3), a heater, and temperature sensors 42 (FIG. 4), which are on the liquid ejection head 13.

In the controller of the liquid ejection apparatus 1, upon receipt of a print job from a user or a different communications apparatus, the CPU causes the RAM to store image data relating to the print job and outputs a command to execute the print job based on programs stored in the ROM. The controller controls each driver IC based on the command to execute printing operation based on the image data stored in the RAM. The controller receives detection signals from the temperature sensors 42 and controls the heater on and off times.

Liquid Ejection Head Structure

Figure 3:
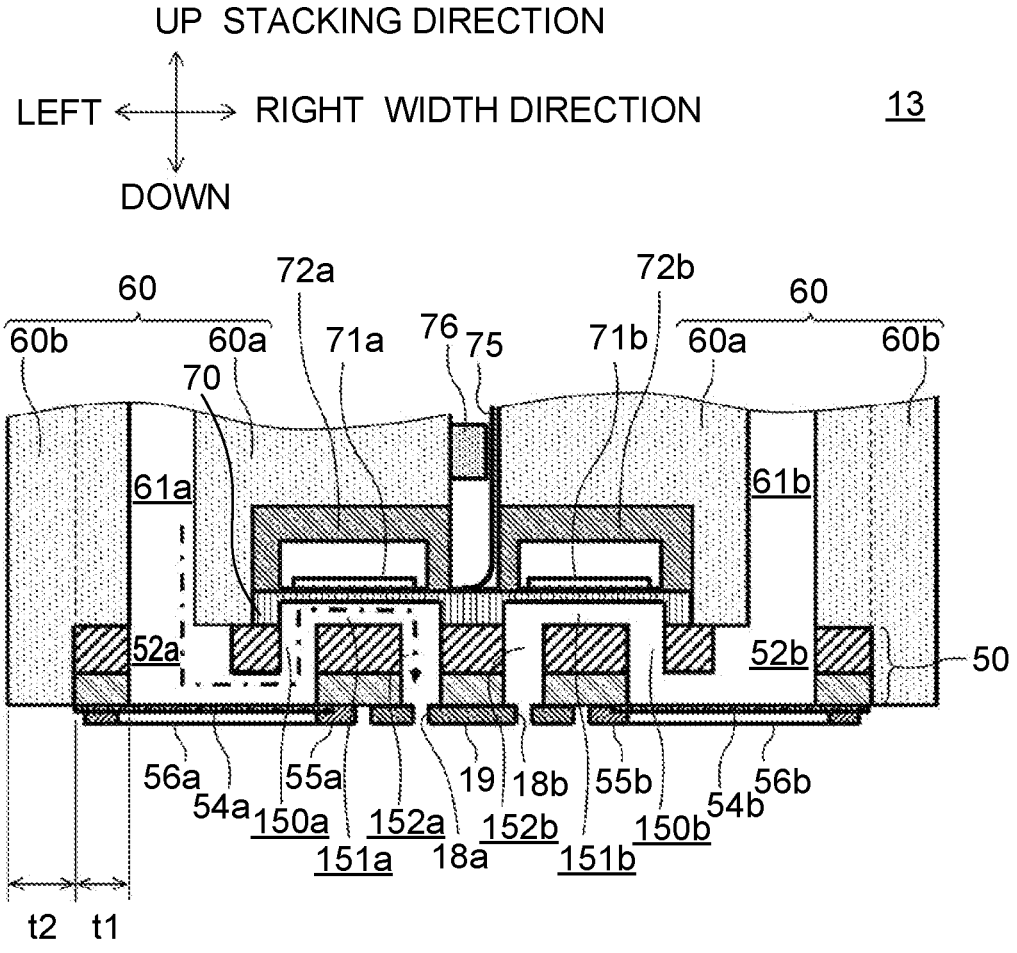
FIG. 3 is a cross-sectional view of the liquid ejection head taken along a line A-A of FIG. 2.

The structure of the liquid ejection head 13 will be described with reference to FIGS. 2 and 3. FIG. 2 is a partial cross-sectional view of the liquid ejection head 13 of FIG. 1 when viewed from the nozzle surface 19. FIG. 3 is a cross-sectional view of the liquid ejection head 13 taken along a line A-A of FIG. 2. An up-down direction in FIG. 2 corresponds to a nozzle row direction (or a longitudinal direction). A left-right direction in FIG. 2 indicates a width direction of the liquid ejection head 13, corresponding to the scanning direction in FIG. 1. An up-down direction in FIG. 3 indicates a height direction of the liquid ejection head 13 with its lower surface near the nozzle surface 19. A left-right direction in FIG. 3 indicates the width direction of the liquid ejection head 13.

As shown in FIG. 2 as viewed from the nozzle surface 19, the liquid ejection head 13 has a first manifold 52*a* on the left side and a second manifold 52*b* on the right side. The liquid ejection head 13 further has first individual channels 53*a* corresponding to first nozzles 18*a* located near the center in the width direction further than the first manifold 52*a*, and second individual channels 53*b* corresponding to second nozzles 18*b* located near the center in the width direction further than the second manifold 52*b*. The first nozzle row Q1 and the second nozzle row Q2 are located between the first manifold 52*a* and the second manifold 52*b*.

As shown in FIG. 3, the liquid ejection head 13 includes a channel structure 50 formed of a micro-fabricable material including, for example, silicon, and a supply channel structure 60 formed of a material having a lower thermal conductivity than a material of the channel structure 50. In this embodiment, the supply channel structure 60 is formed of, for example, synthetic resin.

The channel structure 50 is formed by stacked plates having grooves and holes therein. The channel structure 50 has liquid ejection channels 51 (a first liquid ejection channel 51*a* that and a second liquid ejection channel 51*b*) that are defined by the grooves and holes to guide liquid to the nozzles 18. The first liquid ejection channel 51*a* and the second liquid ejection channel 51*b* may be hereinafter referred just to as a liquid ejection channel or channels 51 unless description requires a distinction therebetween. A stacking direction in which plates are stacked is the same as the up-down direction, and the width direction of the liquid ejection head 13 is orthogonal to the stacking direction and the nozzle row direction.

A liquid ejection channel 51 includes individual channels 53 and a manifold 52 elongated in the nozzle row direction and supplying liquid to each of the individual channels 53. Specifically, the first liquid ejection channel 51*a* includes first individual channels 53*a* and the first manifold 52*a*, and the second liquid ejection channel 51*b* includes second individual channels 53*b* and the second manifold 52*b*.

The individual channels 53 are each provided for a corresponding one of the nozzles 18 and connected to the manifold 52. Each first individual channel 53*a* has a first nozzle 18*a*, a first supply throttle 150*a*, a first pressure chamber 151*a*, and a first descender 152*a*. Each second individual channel 53*b* has a second nozzle 18*b*, a second supply throttle 150*b*, a second pressure chamber 151*b*, and a second descender 152*b*. The first supply throttle 150*a* and the second supply throttle 150*b* may be hereinafter referred just to as a supply throttle or throttles 150, the first pressure chamber 151*a* and the second pressure chamber 151*b* may be hereinafter referred just to as a pressure chamber or chambers 151, and the first descender 152*a* a and the second descender 152*b* may be hereinafter referred just to as a descender or descenders 152, unless description requires a distinction therebetween.

Each individual channel 53 has a supply throttle 150 that communicates with a pressure chamber 151 and a manifold 52, and a descender 152 that communicates with the pressure chamber 151 and a nozzle 18. The supply throttle 150 is connected at its upper end to the manifold 52 and connected at its lower end to the pressure chamber 151. The supply throttle 150 is a hole extending in the stacking direction. The descender 152 is connected, at its upper end, to the pressure chamber 151 and connected, at its lower end, to the nozzle 18. The descender 152 is located at a position overlapping with the pressure chamber 151 when viewed in the stacking direction. The descender 152 is a hole extending downward in the stacking direction.

The pressure chamber 151 is located between the supply throttle 150 and the descender 152. The pressure chamber 151 applies a pressure to liquid supplied from the supply throttle 150 to eject liquid from the nozzle 18 through the descender 152. The upper end of the pressure chamber 151 is defined by a vibration plate 70 that is deformable in its thickness direction. The vibration plate 70 is formed by sintering an upper surface of the channel structure 50 formed of silicon. In the first embodiment, the vibration plate 70 is located at a position overlapping with the pressure chamber 151 on the upper surface of the channel structure 50 when viewed in the stacking direction.

An upper surface of the vibration plate 70 includes first piezoelectric elements 71*a* and second piezoelectric elements 71*b*. Each of the first piezoelectric elements 71*a* is located at a position overlapping with a corresponding one of first pressure chambers 151*a*. Each of the second piezoelectric elements 71*b* is located at a position overlapping with a corresponding one of second pressure chambers 151*b*. The first piezoelectric elements 71*a* and the second piezoelectric elements 71*b* may be hereinafter referred just to as a piezoelectric element or elements 71 unless description requires a distinction therebetween.

A piezoelectric element 71 includes a common electrode (not shown), a piezoelectric layer (not shown), and an individual electrode (not shown). The common electrode, the piezoelectric layer, and the individual electrode are arranged in this order on the upper surface of the vibration plate 70. The common electrode and the piezoelectric layer are provided in common for one nozzle row Q, and the individual electrode is provided in association with each pressure chamber 151. The piezoelectric layer is formed of a piezoelectric material including lead zirconate titanate (PZT), for example. The common electrode is maintained at a ground potential. Each individual electrode is connected to the head driver IC. Each individual electrode is set to a ground potential or a specified driving potential individually by the head driver IC. A portion of the piezoelectric layer located between the common electrode and an individual electrode functions as an active portion that is polarized in the stacking direction when the individual electrode is energized.

When no liquid is ejected from any nozzles 18 (standby state), all individual electrodes of the piezoelectric elements 71 are maintained at the ground potential as with the common electrode. When liquid is to be ejected from a specified nozzle 18, the potential of an individual electrode of a piezoelectric element 71 corresponding to a pressure chamber 151 connected to the specified nozzle 18 is switched to a specified driving potential by the controller. This causes the piezoelectric element 71 to become deformed or protrude toward the pressure chamber 151. Accordingly, the volume of the pressure chamber 151 decreases, the pressure in liquid in the pressure chamber 151 rises, and then liquid is ejected from the specified nozzle 18 in form of droplets. After liquid ejection, the potential of the individual electrode returns to the ground potential. The piezoelectric element 71 thus returns to the state of before the piezoelectric element 71 becomes deformed.

The first piezoelectric elements 71*a* are surrounded and sealed by a first sealing board 72*a* located above the channel structure 50 The second piezoelectric elements 71*b* are surrounded and sealed by a second sealing board 72*b* located above the channel structure 50. The first sealing board 72*a* and the second sealing board 72*b* may be hereinafter referred just to as a sealing board or boards 72 unless description requires a distinction therebetween. A sealing board 72 hermetically seals piezoelectric elements 71 to prevent air oxidation of the piezoelectric elements 71. The sealing board 72 is formed of a material including silicon, for example.

The sealing board 72 may be shaped like a rectangular prism extending in the nozzle row direction and having a hollow to collectively seal the piezoelectric elements 71 each provided for a corresponding one of the nozzles 18. The first sealing board 72*a* and the second sealing board 72*b* are spaced apart from each other in the width direction of the channel structure 50.

Figure 4:
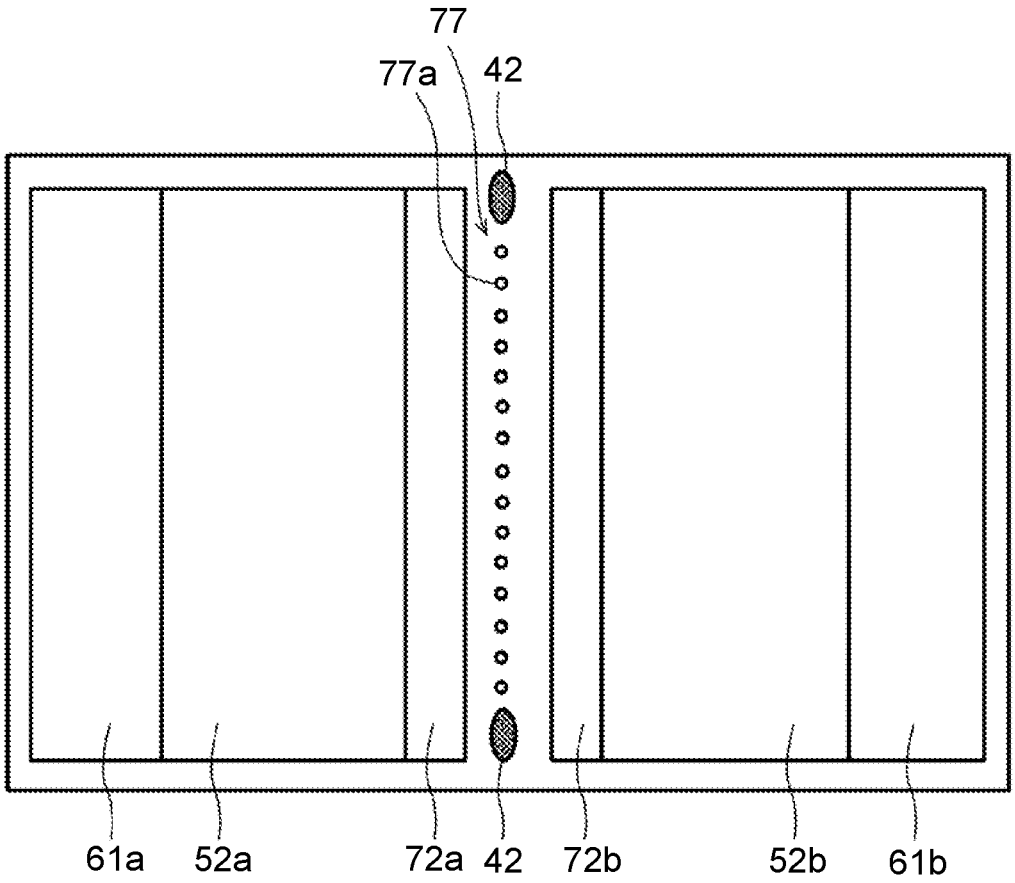
FIG. 4 is a schematic plan view of the liquid head of FIG. 3 when viewed from the top.

A COF (chip on film) 75 is disposed in a gap between the first sealing board 72*a* and the second sealing board 72*b*. The COF 75 is an example of a flexible board and connected to the head driver IC that controls driving of the piezoelectric elements 71. As shown in FIG. 4, an electrical connection portion 77 that electrically connects the COF 75 and the piezoelectric elements 71 has a plurality of contact points 77*a* arranged in the nozzle row direction. FIG. 4 is a schematic plan view of the liquid head 13 of FIG. 3 when viewed from the top.

The gap between the first sealing board 72*a* and the second sealing board 72*b* is filled with a potting material 76, which fixedly positions the COF 75. The potting material 76, which blocks the gap between the first sealing board 72*a* and the second sealing board 72*b*, prevents heat in liquid passing through the liquid ejection channels 51 from escaping from the gap to outside the liquid ejection head 13. The potting material 76 includes an adhesive agent having a lower thermal conductivity than materials of the first sealing board 72*a*, the second sealing board 72*b*, and the channel structure 50. This reduces heat dissipation from the gap effectively compared to a structure where a material having as high thermal conductivity as the channel structure 50 is used to block the gap between the first sealing board 72*a* and the second sealing board 72*b*.

The supply channel structure 60 located over the channel structure 50 has supply channels 61 that supply liquid to the liquid ejection channels 51. Specifically, a first supply channel 61*a* and a second supply channel 61*b*, which are defined in the supply channel structure 60, are provided above the first manifold 52*a* and the second manifold 52*b*, respectively, which are defined in the channel structure 50. The first supply channel 61*a* communicates with the first manifold 52*a*, and the second supply channel 61*b* communicates with the second manifold 52*b*. The first supply channel 61*a* and the second supply channel 61*b* may be hereinafter referred just to as a supply channel or channels 61 unless description requires a distinction therebetween.

The first piezoelectric elements 71*a*, the second piezoelectric elements 71*b*, the first sealing board 72*a* sealing the first piezoelectric elements 71*a*, and the second sealing board 72*b* sealing the second piezoelectric elements 71*b* are located above the channel structure 50 and between the supply channel structure 60 provided above the first manifold 52*a* and the supply channel structure 60 provided above the second manifold 52*b*.

As shown in FIG. 3, the supply channel structure 60 has main portions 60*a* and covering portions 60*b*. The main portions 60*a* are located on and above the channel structure 50. Each of the covering portions 60*b* covers at least a portion of an end surface on a side of the channel structure 50 in a direction orthogonal to the stacking direction. Specifically, the supply channel structure 60 is structured such that the main portions 60*a* cover almost all of an upper surface of the channel structure 50 and the covering portions 60*b* cover end surfaces on sides of the channel structure 50. The supply channel structure 60 having a lower thermal conductivity than the channel structure 50 covers the upper surface and the end surfaces of the channel structure 50, thus reducing heat dissipation from the liquid ejection channels 51 to outside. The liquid ejection head 13 including a heater in its upper portion may prevent liquid heated by the heater from undergoing cooling during which liquid passes through the liquid ejection channels 51 and reaches nozzles 18. Each of the covering portions 60*b* of the supply channel structure 60 covers an upper end portion of the channel structure 50 and extends from an upper end portion of the channel structure 50 along an end surface on a side of the channel structure 50 toward a position where a first damper 54*a* or a second damper 54*b* is provided. The first damper 54*a* and the second damper 54*b* are located defining a lower surface of the channel structure 50, thereby each defining a portion (a manifold 52) of a liquid ejection channel 51. The first damper 54*a* and the second damper 54*b* are configured to attenuate remaining vibrations propagating from liquid flowing.

In FIG. 3 where the liquid ejection head 13 is viewed in the nozzle row direction, a thickness dimension t1 of an outer wall portion, which defines each manifold 52, of the channel structure 50 is smaller than a thickness dimension t2 of the covering portion 60*b* of each supply channel structure 60 covering the outer wall portion. In other words, the thickness dimension t2 is greater than the thickness dimension t1. In FIG. 3, the thickness of the outer wall portion defining the manifold 52 is on each of outer portions on left and right sides of the channel structure 50 forming the manifolds 52. As the thickness dimension t2 of the covering portion 60*b* covering the outer wall portion defining the manifold 52 is greater than the thickness dimension t1 of the outer wall portion, heat dissipation from the manifold 52 can be reduced effectively. The thickness dimension t1 ranges from 0.5 to 1.0μ, and the thickness dimension t2 ranges from 1.0 to 2.0μ.

The supply channel structure 60 is structured as follows to create the gap. In a plan view from the nozzle surface 19 in the stacking direction, the gap is defined by side surfaces of the first sealing board 72*a* and the second sealing board 72*b*, and side surfaces, near the gap, of the supply channel structure 60 covering the first sealing board 72*a* and the second sealing board 72*b*, which are flush with one another. In other words, the supply channel structure 60 covers the first sealing board 72*a* and the second sealing board 72*b* except for the gap. This structure reduces heat dissipation from the liquid ejection channels 51 to outside more effectively.

As shown in FIG. 3, the liquid ejection head 13 has the nozzle surface 19 (nozzle plate) at its lowermost end. The nozzles 18 are formed to penetrate the nozzle surface 19 in its thickness direction parallel to the stacking direction. The nozzle surface 19 has a first nozzle row Q1 and a second nozzle row Q2 each formed of a specified number of nozzles 18. The first nozzle row Q1 and the second nozzle row Q2 are located parallel to each other with a space therebetween in the width direction. The nozzles 18 in each nozzle row Q are spaced apart from each other in its nozzle row direction.

The liquid ejection channels 51 have a first damper 54*a* and a second damper 54*b*, which are elongated in the nozzle row direction. The first damper 54*a* is located below the first manifold 52*a* and the second damper 54*b* is located below the second manifold 52*b*. The first damper 54*a* and the second damper 54*b* may be hereinafter referred just to as a damper or dampers 54 unless description requires a distinction therebetween.

The dampers 54 are configured to, when liquid vibrates due to vibration waves propagating through the manifolds 52, become deformed in their thickness direction and thereby to attenuate vibrations propagating from liquid flowing. The dampers 54 thus reduce fluctuations of the liquid pressure in the manifolds 52, suppressing unwanted phenomena such as crosstalk, in which liquid ejection from a nozzle 18 may affect liquid ejection from its adjacent nozzle 18. In the first embodiment, the dampers 54 are formed of resin films. The first damper 54*a* is held by a first holding frame 55*a* and defines a lower surface of the first liquid ejection channel 51*a*, more specifically, a lower surface of the first manifold 52*a*. The second damper 54*b* is held by a second holding frame 55*b* and defines a lower surface of the second liquid ejection channel 51*b*, more specifically, a lower surface of the second manifold 52*b*. The first holding frame 55*a* and the second holding frame 55*b* may be hereinafter referred just to as a holding frame or holoding flames 55 unless description requires a distinction therebetween.

The holding frames 55 are formed of a material having a lower thermal conductivity than a material of the channel structure 50. For example, the holding frames 55 may be formed of resin. The holding frame 55 formed of resin may reduce heat dissipation from the liquid ejection channels 51 to outside. The first holding frame 55*a* and the second holding frame 55*b* are covered, at their lower surfaces, by a first cover portion 56*a* and a second cover portion 56*b*, respectively, which are formed of a material having a lower thermal conductivity than a material of the channel structure 50. The first cover portion 56*a* and the second cover portion 56*b* may be hereinafter referred just to as a cover portion or portions 56 unless description requires a distinction therebetween.

Examples of a material having a lower thermal conductivity than a material of the channel structure 50 include resin, and the cover portions 56 may be formed of resin films. The cover portions 56 covering the holding frames 55 may reduce heat dissipation from the liquid ejection channels 51 to outside. Even when the holding frames 55 are formed of a material, for example, metal, having a higher thermal conductivity than a material of the channel structure 50, the cover portions 56 covering the holding frames 55 may reduce heat dissipation. In a case where the holding frames 55 formed of resin are sufficient to reduce heat dissipation, the cover portions 56 may be omitted.

The liquid ejection head 13 includes temperature sensors 42 to check whether a temperature of liquid flowing in the liquid ejection channels 51 is a specified temperature. The temperature sensors 42 are disposed near the electrical connection portion 77 that is located in a central portion of the channel structure 50 in the width direction. As shown in FIG. 4, for example, the temperature sensors 42 are each disposed near a corresponding one of ends of the electrical connection portion 77 elongated in the nozzle row direction. The temperature sensors 42 disposed at such positions can measure temperature of liquid flowing in each channel. The temperature sensors 42 are not limited to being disposed correspondingly near one end of the electrical connection portion 77 as described, but may be disposed near, for example, a central portion of the electrical connection portion 77. Alternatively, the temperature sensors 42 may be disposed correspondingly on a side surface of the first sealing board 72*a* and a side surface of the second sealing board 72*b*. Further alternatively, the temperature sensors 42 may be disposed on side surfaces of the covering portions 60*b* of the supply channel structure 60 near the nozzle surface 19.

In this case, liquid supplied through the supply channels 61 to the liquid ejection channels 51 may be heated to a specified temperature by a heater before flowing in the supply channels 61. Alternatively, a heater in the liquid ejection head 13 may heat liquid flowing in the liquid ejection channels 51. In this case, the heater is preferably disposed at a position adjacent to the channel structure 50 or a position where heat is conducted to the channel structure 50. Examples of such a position where heat is conducted to the channel structure 50 include a position on the sealing board 72 disposed on the channel structure 50.

Second Embodiment

Figure 5:
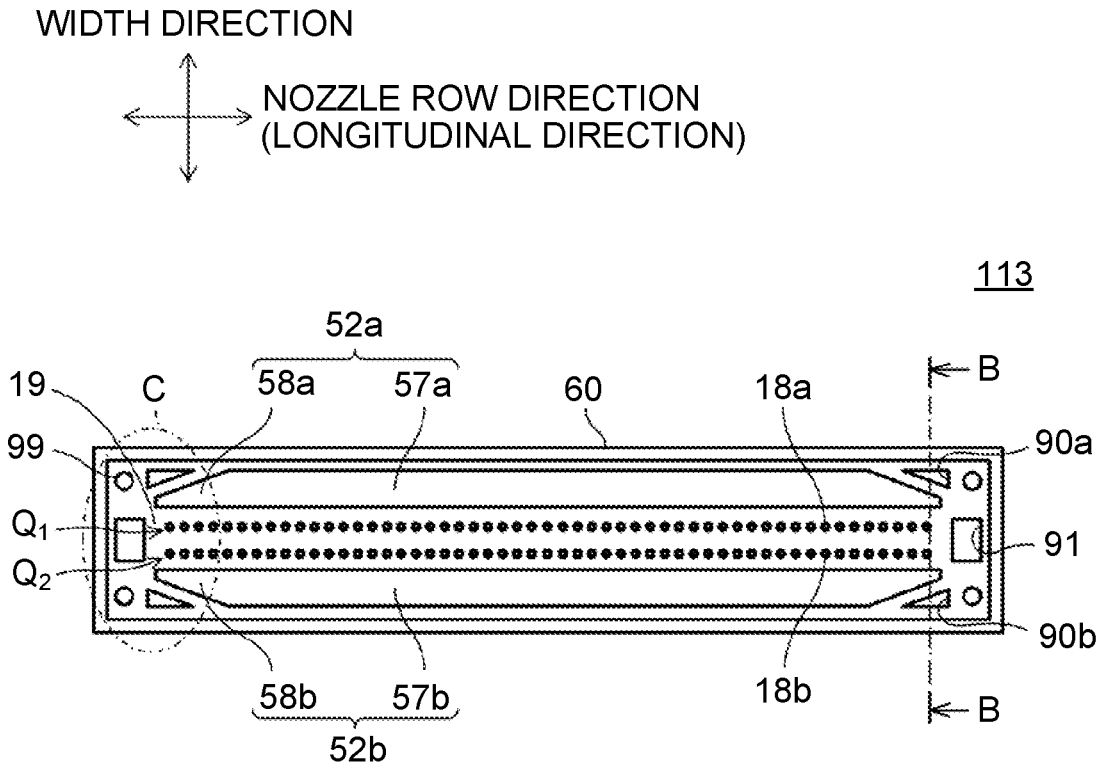
FIG. 5 is a cross-sectional view of a channel structure of a liquid ejection head according to a second embodiment, when viewed from a nozzle surface.
Figure 6:
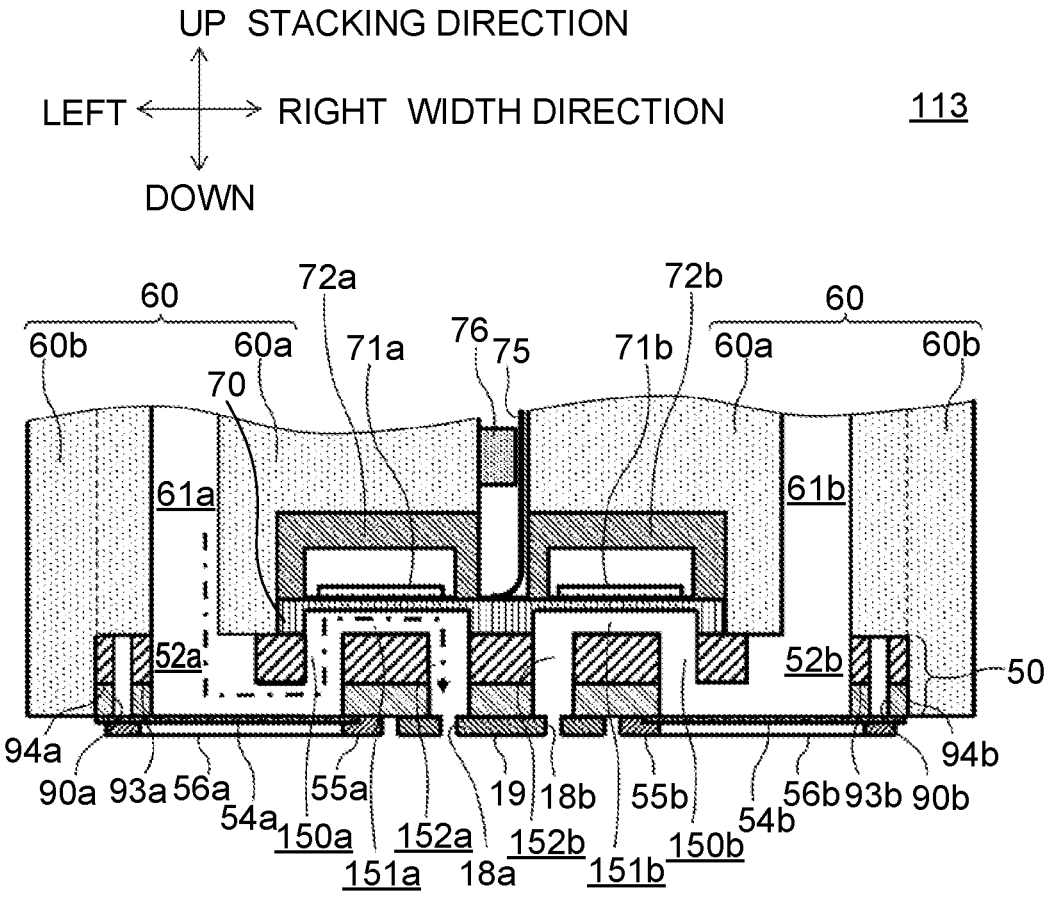
FIG. 6 is a cross-sectional view of the liquid ejection head taken along a line B-B of FIG. 5.

A liquid ejection head 113 according to a second embodiment will be described with FIGS. 5 and 6. FIG. 5 is a cross-sectional view of a channel structure 50 of the liquid ejection head 113 according to the second embodiment, when viewed from a nozzle surface 19. FIG. 6 is a cross-sectional view of the liquid ejection head 113 taken along a line B-B of FIG. 5. The liquid ejection head 113 according to the second embodiment is different from the liquid ejection head 13 according to the first embodiment in structure of the channel structure 50. In the following description, the components substantially the same as those in the first embodiment are given the same reference numerals as those components, and will not be described.

In the liquid ejection head 113 according to the second embodiment shown in FIGS. 5 and 6, liquid ejection channels 51 (FIG. 3) include manifolds 52 that supply liquid supplied from the supply channel 61 to individual channels 53 each having a corresponding one of nozzles 18 provided in the nozzle row direction. When viewed in a plan view from the nozzle surface 19 formed with the nozzles 18, a first manifold 52*a* has a first main portion 57*a* elongated in the nozzle row direction and a first narrow portion 58*a* narrower than the first main portion 57*a* in a width direction orthogonal to the nozzle row direction, and a second manifold 52*b* has a second main portion 57*b* elongated in the nozzle row direction and a second narrow portion 58*b* narrower than the second main portion 57*b* in the width direction. The first main portion 57*a* and the second main portion 57*b* may be hereinafter referred just to as a main portion or portions 57, and the first narrow portion 58*a* and the second narrow portion 58*b* may be hereinafter referred just to as a narrow portion or portions 58, unless description requires a distinction therebetween.

In an example shown in FIG. 5, both end portions of the manifolds 52 elongated in the nozzle row direction function as narrow portions 58. When viewed in a plan view from the nozzle surface 19, each of the narrow portions 58 tapers toward a corresponding end of the manifolds 52 in the nozzle row direction. As shown in FIGS. 5 and 6, the channel structure 50 has first-side gaps 90*a* and second-side gaps 90*b*, each provided in an area of the channel structure 50 closer to an exterior of the channel structure 50 than a corresponding one of the narrow portions 58 in the width direction. The first-side gaps 90*a* and the second-side gaps 90*b* may be hereinafter referred just to as a side gap or gaps 90 unless description requires a distinction therebetween. The side gap 90 corresponds to a first gap of the disclosure. As shown in FIG. 5, when viewed in a plan view from the nozzle surface 19, four side gaps 90 are provided in end portions of the manifolds 52 in the nozzle row direction, each corresponding to one of four places in the channel structure 50 where the side gaps 90 overlap the end portions in the width direction. Thus, the channel structure 50 has dead space around each of the narrow portions 58 of the manifolds 52, which functions as airspace. This may obviate the need to upsize the head 113 and reduce heat dissipation from the manifolds 52.

In a plan view from the nozzle surface 19, the channel structure 50 has end gaps 91 in its end areas outside of the nozzle rows Q in the nozzle row direction. An end gap 91 corresponds to a second gap of the disclosure. The end areas of the channel structure 50 outside of the nozzle row Q has no holes nor grooves, and are thus unused areas. In the channel structure 50, airspace is provided in unused areas. This may obviate the need to upsize the head 113 and reduce heat dissipation from the liquid ejection channels 51.

As shown in FIG. 5, four corners of the channel structure 50 in a plan view from the nozzle surface 19 each have a positioning hole 99 used for positioning plates stacked one on another to form the channel structure 50. In the liquid ejection head 113 according to the second embodiment shown in FIG. 5, the channel structure 50 has the side gaps 90 and the end gaps 91 in dead space near the four corners each having a positioning hole 99.

Figure 7:
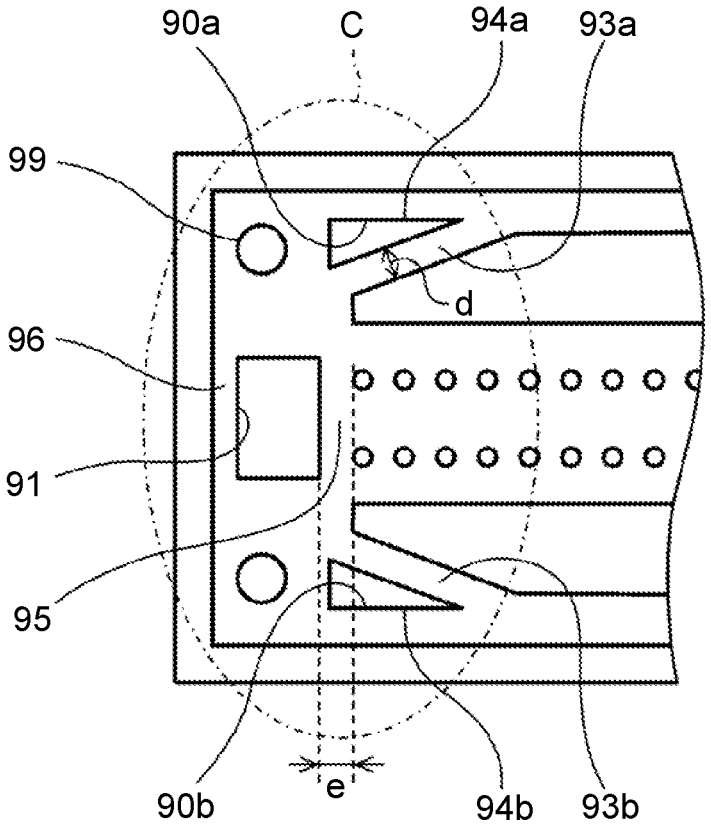
FIG. 7 is a partially enlarged cross-sectional view of a channel structure in a C area of FIG. 5.

As shown in FIG. 7, the channel structure 50 has a first-side boundary portion 93*a* that separates the first manifold 52*a* and the first-side gap 90*a* by a specified distance d (for example, d=0.5 mm), and a second-side boundary portion 93*b* that separates the second manifold 52*b* and the second-side gap 90*b* by a specified distance d (for example, d=0.5 mm). The first-side boundary portion 93*a* and the second-side boundary portion 93*b* may be hereinafter referred just to as a side boundary portion or portions 93 unless description requires a distinction therebetween. The side boundary portion 93 corresponds to a first boundary portion of the disclosure. FIG. 7 is a partially enlarged cross-sectional view of the channel structure 50 in a C area of FIG. 5.

Side boundary portions 93 of the channel structure 50 are used for joining the channel structure 50 and the supply channel structure 60 located over the channel structure 50. The channel structure 50 has a first-side edge portion 94*a* that defines the first-side gap 90*a* together with the first-side boundary portion 93*a*. The channel structure 50 has a second-side edge portion 94*b* that defines the second-side gap 90*b* together with the second-side boundary portion 93*b*. Thus, the first-side gap 90*a* is defined by the first-side boundary portion 93*a* and the first-side edge portion 94*a*, and the second-side gap 90*b* is defined by the second-side boundary portion 93*b* and the second-side edge portion 94*b*. This structure provides strength around the first-side gap 90*a* and the second-side gap 90*b*.

As shown in FIG. 7, the channel structure 50 viewed in a plan view from the nozzle surface 19 has an end boundary portion 95 that separates the end gap 91 and each end of the nozzle rows Q by a specified distance e (for example, e=0.5 mm). The end boundary portion 95 corresponds to a second boundary portion of the disclosure. The end boundary portion 95 of the channel structure 50 is used for joining the channel structure 50 and the supply channel structure 60 located on and above the channel structure 50.

The channel structure 50 has an end edge portion 96 that defines the end gap 91 together with the end boundary portion 95. Thus, the end gap 91 is defined by the end boundary portion 95 and the end edge portion 96. This structure provides strength around the end gap 91.

Figure 8:
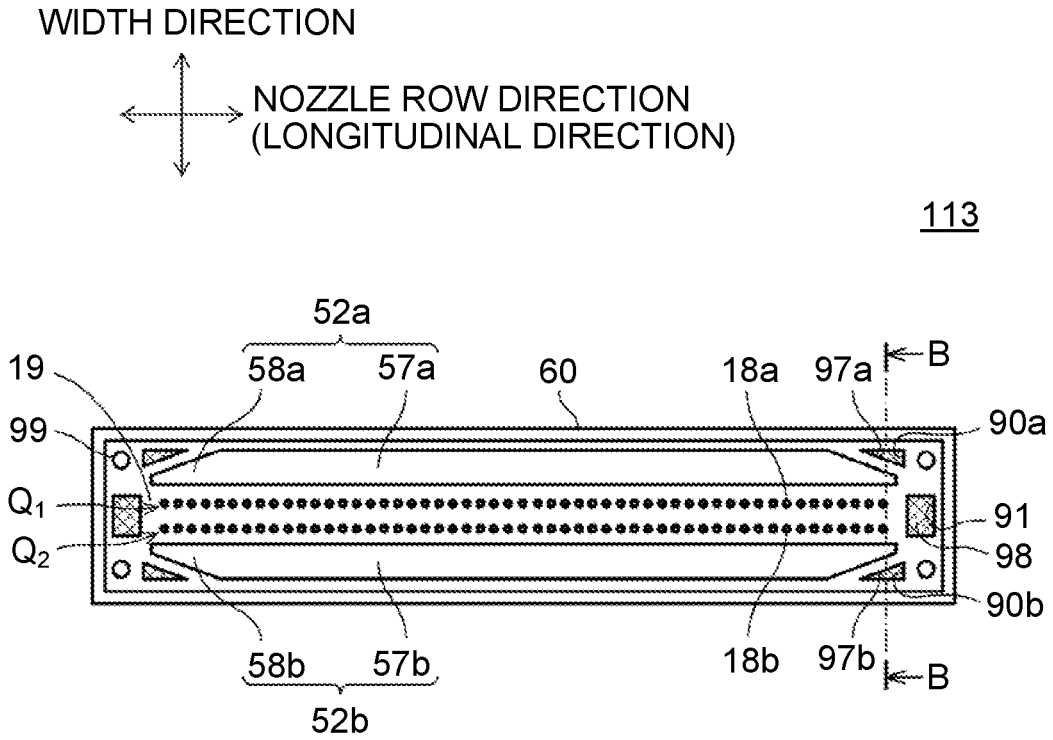
FIG. 8 is a cross-sectional view of a channel structure of a liquid ejection head according to the second embodiment, when viewed from a nozzle surface.
Figure 9:
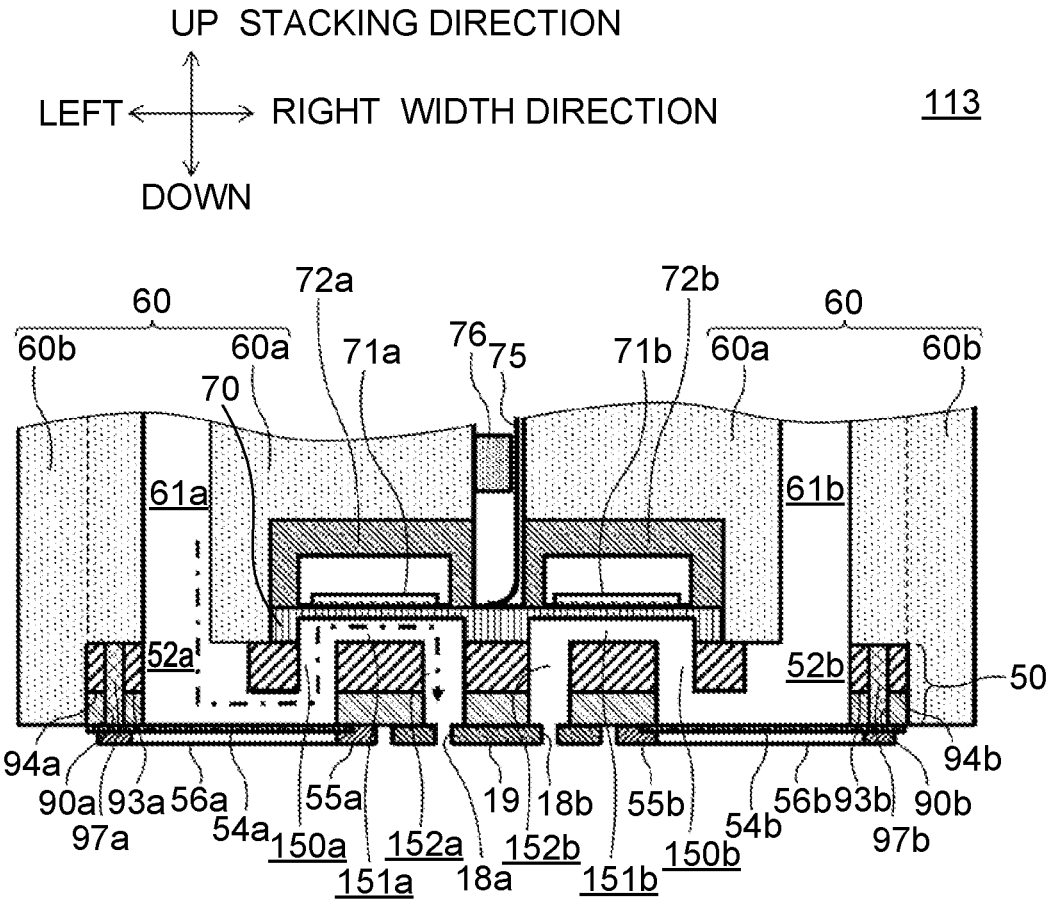
FIG. 9 is a cross-sectional view of the liquid ejection head taken along a line B-B of FIG. 8.

As shown in FIGS. 8 and 9, the first-side gap 90*a*, the second-side gap 90*b*, and the end gap 91 may be filled with resin members. FIG. 8 is a cross-sectional view of the channel structure 50 of the liquid ejection head 113 according to the second embodiment, when viewed from the nozzle surface 19. FIG. 9 is a cross-sectional view of the liquid ejection head 113 taken along a line B-B of FIG. 8.

Specifically, the first-side gap 90*a* is filled with a first resin member 97*a* and the second-side gap 90*b* is filled with a second resin member 97*b*. The end gap 91 is filled with a third resin member 98. The first resin member 97*a* and the second resin member 97*b* may be hereinafter referred just to as a resin member or members 97 unless description requires a distinction therebetween.

The first-side gap 90*a*, the second-side gap 90*b*, and the end gap 91 are filled with resin members, thus reducing heat dissipation from the manifold 52 more effectively.

The resin member 97 may be an integral part of the supply channel structure 60 as described below. As shown in FIG. 9, the supply channel structure 60 is located over the channel structure 50. The supply channel structure 60 has, as resin members 97, protrusions that each protrude downward at a position corresponding to one of the first-side gap 90*a* and the second-side gap 90*b*. The protrusions have shapes similar to those of the first-side gap 90*a* and the second-side gap 90*b*.

As the resin members 97 are protrusions that are integral parts of the supply channel structure 60, no additional members are required for filling the first-side gap 90*a* and the second-side gap 90*b*. This reduces the number of parts required for the liquid ejection head 113. The third resin member 98 may be an integral part of the supply channel structure 60 similarly to the resin members 97.

The resin members 97 may be formed of a resin different from that of the supply channel structure 60. For example, the resin members 97 may be formed of a polyurethane-based resin. In this case, an appropriate resin in terms of fabricability and heat insulation properties can be selected for the resin members 97 that fill the first-side gap 90*a* and the second-side gap 90*b*, as the resin members 97 can be formed of a resin different from that of the supply channel structure 60. The third resin member 98 may be formed of a resin different from that of the supply channel structure 60 similarly to the resin members 97. Alternatively, one of the resin members 97 and the third resin member 98 may be integrally formed with the supply channel structure 60 and the other one thereof may be formed of a resin different from that of the supply channel structure 60.

As described above, in an aspect of the disclosure, a liquid ejection head 13 includes a nozzle surface 19 having a plurality of nozzles 18, a channel structure 50 stacked on the nozzle surface 19 in a stacking direction, and a supply channel structure 60. The channel structure 50 has a liquid ejection channel 51 communicating with the nozzles 18. The supply channel structure 60 is formed of a material having a lower thermal conductivity than a material of the channel structure 50. The supply channel structure 60 has a supply channel 61 communicating with the liquid ejection channel 51. The supply channel structure 60 has a covering portion 60*b* covering at least a portion of an end surface on a side of the channel structure 50 in the direction orthogonal to the stacking direction.

According to the above structure, the covering portion 60*b* of the supply channel structure 60 having a lower thermal conductivity than a material of the channel structure 50 covers the end surface of the channel structure 50, thus reducing heat dissipation from the liquid ejection channel 51 to outside.

In an aspect of the disclosure, in the liquid ejection head 13 structured above, when a side of the liquid ejection head 13 with the nozzle surface 19 faces downward, and a side of the liquid ejection head 13 opposite to the nozzle surface 19 faces upward, the supply channel structure 60 is located over the channel structure 50. The liquid ejection head 13 further includes a damper 54 located defining a lower surface of the channel structure 50 thereby defining a portion of the liquid ejection channel 51. The damper 54 is configured to attenuate remaining vibrations propagating from liquid flowing. The covering portion 60*b* of the supply channel structure 60 extends from an upper end portion of the channel structure 50 along the end surface thereof toward a position where the damper is provided.

According to the above structure, the covering portion 60*b* of the supply channel structure 60 extends from the upper end portion of the channel structure 50 toward the position where the damper 54 is provided, thus reducing heat dissipation from the liquid ejection channel 51 to outside more effectively.

In an aspect of the disclosure, the liquid ejection head 13 structured above further includes a holding frame 55 holding the damper 54. The holding frame 55 may be formed of a material having a lower thermal conductivity than a material of the channel structure 50. For example, the holding frames 55 may be formed of resin.

According to the above structure, the holding frame 55 holds the damper 54, thereby defining the lower surface of the channel structure 50. The holding frame 55 is formed of a material having a lower thermal conductivity than a material of the channel structure 50, that is, resin, thus reducing heat dissipation.

In an aspect of the disclosure, the liquid ejection head 13 structured above further includes a holding frame 55 holding the damper 54 and a cover portion 56 covering a lower surface of the holding frame 55. The cover portion 56 is formed of a material having a lower thermal conductivity than a material of the channel structure 50.

According to the above structure, the holding frame 55 holds the damper 54, thereby defining the lower surface of the channel structure 50. The cover portion 56 reduces heat dissipation from the holding frame 55 even when the holding frame 55 is formed of a material having a higher thermal conductivity than resin.

In an aspect of the disclosure, in the liquid ejection head 13 structured above, the cover portion 56 is formed of a resin film.

According to the above structure, the cover portion 56 formed of a resin film reduces heat dissipation from the holding frame 55 even when the holding frame 55 is formed of a material having a higher thermal conductivity than the resin film.

In an aspect of the disclosure, the liquid ejection head 13 structured above further includes a vibration plate 70, a plurality of first piezoelectric elements 71*a*, a plurality of second piezoelectric elements 71*b*, a COF 75 as an example of a flexible board, an electrical connection portion 77 having a plurality of contact points 77*a*, and a temperature sensor 42. The nozzles 18 include a plurality of first nozzles 18*a* forming a first nozzle row Q1 in a nozzle row direction as an example of another direction orthogonal to the width direction and the stacking direction, and a plurality of second nozzles 18*b* forming a second nozzle row Q2 in the other direction. The liquid ejection channel 51 includes a first liquid ejection channel 51*a* and a second liquid ejection channel 51*b*. The first liquid ejection channel 51*a* includes a plurality of first pressure chambers 151*a* each communicating with a corresponding one of the first nozzles 18*a*. The second liquid ejection channel 51*b* includes a plurality of second pressure chambers 151*b* each communicating with a corresponding one of the second nozzles 18*b*. The COF 75 is located on an upper surface of the channel structure 50 and defines upper ends of the first pressure chambers 151*a* and the second pressure chambers 151*b*. Each of the first piezoelectric elements 71*a* is located, on an upper surface of the vibration plate 70, in association with a corresponding one of the first pressure chambers 151*a*. Each of the second piezoelectric elements 71*b* is located, on the upper surface of the vibration plate 70, in association with a corresponding one of the second pressure chambers 151*b*. The electrical connection portion is elongated in the other direction. The contact points 77*a* of the electrical connection portion 77 are aligned in the other direction and located between the first piezoelectric elements 71*a* and the second piezoelectric elements 71*b* in the width direction, and electrically connect the first piezoelectric elements 71*a* and the second piezoelectric elements 71*b* to the flexible board 75. The temperature sensor 42 is located at each end of the electrical connection portion 77 in the nozzle row direction.

According to the above structure, the temperature sensor 42 is located between the first piezoelectric elements 71*a* and the second piezoelectric elements 71*b* and at each end of the electrical connection portion 77 elongated in the nozzle row direction. This enables the temperature sensor 42 to appropriately measure a temperature of liquid to be ejected from the nozzles 18 from the pressure chambers 151 (including the first pressure chambers 151*a* and the second pressure chambers 151*b*) in each of the first nozzle row Q1 and the second nozzle row Q2.

In an aspect of the disclosure, the liquid ejection head 13 structured above further includes a first sealing board 72*a* surrounding and sealing the first piezoelectric elements 71*a*, and a second sealing board 72*b* surrounding and sealing the second piezoelectric elements 71*b*. The COF 75 is disposed in a gap between the first sealing board 72*a* and the second sealing board 72*b*. In a plan view from the nozzle surface 19 in the stacking direction, the gap is defined by side surfaces of the first sealing board 72*a* and the second sealing board 72*b*, and side surfaces, near the gap, of the supply channel structure 60 covering the first sealing board 72*a* and the second sealing board 72*b*, which are flush with one another.

In a plan view from the nozzle surface 19 in the stacking direction, the gap is defined by side surfaces of the first sealing board 72*a* and the second sealing board 72*b*, and side surfaces, near the gap, of the supply channel structure 60 covering the first sealing board 72*a* and the second sealing board 72*b*, which are flush with one another. In other words, the supply channel structure 60 covers the first sealing board 72*a* and the second sealing board 72*b* except for the gap. This structure reduces heat dissipation from the liquid ejection channels 51 to outside more effectively.

In an aspect of the disclosure, the liquid ejection head 13 structured above further includes a potting material 76 blocking the gap. According to the above structure, the liquid ejection head 13 uses the potting material 76 to reduce heat dissipation from the gap. The potting material 76 may include an adhesive agent having a lower thermal conductivity than materials of the first sealing board 72*a*, the second sealing board 72*b*, and the channel structure 50. Examples of the potting material 76 including an adhesive agent having a lower thermal conductivity include a two-part epoxy potting material. The potting material 76 includes an adhesive agent having a lower thermal conductivity than materials of the first sealing board 72*a*, the second sealing board 72*b*, and the channel structure 50, thus reducing heat dissipation from the gap more effectively.

In an aspect of the disclosure, in the liquid ejection head 13 structured above, the liquid ejection channel 51 of the channel structure 50 includes a plurality of individual channels 53 each provided for a corresponding one of the nozzles 18, and a manifold 52 configured to supply liquid to each of the individual channels 53. The channel structure 50 has an outer wall portion defining the manifold 52. The outer wall portion of the channel structure 50 is covered by the covering portion 60*b* of the supply channel structure 60. When the liquid ejection head 13 is viewed in the nozzle row direction as an example of another direction orthogonal to the width direction and the stacking direction, a thickness dimension t2 of the covering portion 60*b* is greater than a thickness dimension t1 of the outer wall portion of the channel structure 50.

According to the above structure, as the thickness dimension t2 of the covering portion 60*b* covering the outer wall portion defining the manifold 52 is greater than the thickness dimension t1 of the outer wall portion, heat dissipation from the manifold 52 can be reduced effectively.

In an aspect of the disclosure, in the liquid ejection head 113 structured above, the liquid ejection channel 51 of the channel structure 50 includes a plurality of individual channels 53 each provided for a corresponding one of the nozzles 18, and a manifold 52 configured to supply liquid to each of the individual channels 53. In a plan view from the nozzle surface 19, the manifold 52 has a main portion 57 elongated in the nozzle row direction as an example of another direction orthogonal to the width direction and the stacking direction, and a narrow portion 58 narrower than the main portion 57 in the width direction. In the plan view, the channel structure 50 has a side gap 90 as an example of a first gap in an area from a position where the narrow portion 58 is defined toward an end of the channel structure 50 in the width direction.

When the liquid ejection head 113 is viewed in a plan view from the nozzle surface 19, the manifold 52 is shaped to have the narrow portion 58, and the channel structure 50 has an unused area in its end area, near the narrow portion 58, where the manifold 52 is not provided.

According to the above structure, the side gap 90 is in the unused area, and airspace can be thus provided around the narrow portion 58 of the manifold 52. This may obviate the need to upsize the head 113 and reduce heat dissipation from the manifold 52.

In an aspect of the disclosure, in the liquid ejection head 113 structured above, the side gap 90 is filled with a resin member 97. The resin member 97 blocking the side gap 90 thus reduces heat dissipation from the manifold 52 more effectively.

In an aspect of the disclosure, in the liquid ejection head 113 structured above, when a side of the liquid ejection head 113 with the nozzle surface 19 face downward and a side of the liquid ejection head 113 opposite to the nozzle surface 19 faces upward, the supply channel structure 60 is located over the channel structure 50. The supply channel structure 60 has the resin member 97 filled in the side gap 90. The resin member 97 protrudes downward at a position corresponding to the side gap 90.

According to the above structure, as the resin member 97 filled in the side gap 90 is a protrusion that is an integral part of the supply channel structure 60, no additional members are required for filling the side gap 90. This reduces the number of parts required for the liquid ejection head 113.

In an aspect of the disclosure, in the liquid ejection head 113 structured above, the supply channel structure 60 is formed of a resin, and the resin member 97 filled in the side gap 90 is formed of a resin different from the resin of the supply channel structure 60. In this case, an appropriate resin in terms of fabricability and heat insulation properties can be selected for the resin member 97 filled in the side gap 90, as the resin members 97 can be formed of a resin different from the resin of the supply channel structure 60.

In an aspect of the disclosure, in the liquid ejection head 113 structured above, the narrow portion 58 is located in an end portion of the main portion 57 elongated in the nozzle row direction. In the plan view from the nozzle surface 19, the narrow portion 58 tapers toward an end of the manifold 52 in the nozzle row direction. The side gap 90 is provided in the area of the channel structure 50 from the position where the narrow portion 58 having a tapered shape is defined toward the end of the channel structure 50 in the width direction.

According to the above structure, as each end portion of the manifold 52 tapers, the area of the channel structure 50 from the position where the narrow portion 58 having a tapered shape is defined toward the end of the channel structure 50 in the width direction is an unused area. As the side gap 90 is provided in the unused area, no additional space is required for the side gap 90 in the channel structure 50. This obviates the need to upsize the liquid ejection head 113.

In other words, the side gap 90 is provided in the channel structure 50 at a position overlapping with an end portion of the manifold 52 in the nozzle row direction when viewed in the width direction. The side gap 90 is thus provided near the manifold 52. This reduces heat dissipation from the manifold 52 more effectively.

In an aspect of the disclosure, in the liquid ejection head 113 structured above, the side gap 90 is provided at a position overlapping with the end portion of the main portion 57 when viewed in the width direction. Thus, the channel structure 50 has dead space around the narrow portion 58 of the manifolds 52, which functions as airspace. This may obviate the need to upsize the head 113 and reduce heat dissipation from the manifold 52.

In an aspect of the disclosure, in the liquid ejection head 113 structured above, the channel structure 50 has a side boundary portion 93 as an example of a first boundary portion that separates the manifold 52 and the side gap 90 by a specified distance. The side boundary portion 93 of the channel structure 50 is used for joining the channel structure 50 and the supply channel structure 60.

In an aspect of the disclosure, in the liquid ejection head 113 structured above, in the plan view from the nozzle surface 19, the channel structure 50 has an end gap 91 as an example of a second gap in each of end areas outside of a row Q of the nozzles 18 in the nozzle row direction.

According to the above structure, the channel structure 50 has the end gap 91 in an unused area in each of the end areas outside of the row Q of the nozzles 18 in the nozzle row direction. This may obviate the need to upsize the head 113 and reduce heat dissipation from the liquid ejection channel 51.

In an aspect of the disclosure, in the liquid ejection head 113 structured above, in the plan view from the nozzle surface 19, the channel structure 50 has an end boundary portion 95 as an example of a second boundary portion that separates the end gap 91 and each of the end areas outside the row Q of the nozzles 18 by a specified distance e.

According to the above structure, the end boundary portion 95 of the channel structure 50 is used for joining the channel structure 50 and the supply channel structure 60.

In an aspect of the disclosure, in the liquid ejection head 113 structured above, the channel structure 50 has a side edge portion 94 as an example of a first edge portion and an end edge portion 96 as an example of a second edge portion. The end edge portion 96 defines the side gap 90 together with the side boundary portion 93. The end edge portion 96 defines the end gap 91 together with the end boundary portion 95. Thus, the side gap 90 is defined by the side boundary portion 93 and the side edge portion 94, and the end gap 91 is defined by the end boundary portion 95 and the end edge portion 96. These structures provide strength around the side gap 90 and the end gap 91.

Aspects of the disclosure are applicable to liquid ejection heads used in devices including an inkjet printer configured to eject liquid in form of droplets onto a sheet.

What is claimed is:

1. A liquid ejection head comprising:

a nozzle surface having a plurality of nozzles;

a channel structure stacked on the nozzle surface in a stacking direction, the channel structure having a liquid ejection channel communicating with the nozzles;

a supply channel structure formed of a material having a lower thermal conductivity than a material of the channel structure, the supply channel structure having a supply channel communicating with the liquid ejection channel, wherein the supply channel structure has a covering portion contacting at least a portion of a side end surface of the channel structure in a width direction orthogonal to the stacking direction, and wherein the supply channel structure has a main portion overlapping the plurality of nozzles in the stacking direction;

a damper configured to attenuate remaining vibrations propagating from liquid flowing; and a holding frame holding the damper, the holding frame being formed of a material with a lower thermal conductivity than the material of the channel structure, wherein, when a side of the liquid ejection head with the nozzle surface faces downward and a side of the liquid ejection head opposite to the nozzle surface faces upward, the supply channel structure is located over the channel structure, wherein the damper is located at a lower surface of the channel structure thereby defining a portion of the liquid ejection channel, and wherein the covering portion of the supply channel structure extends from an upper end portion of the channel structure along the side end surface thereof toward a position where the damper is provided.

2. The liquid ejection head according to claim 1, wherein the holding frame is formed of resin.

3. The liquid ejection head according to claim 1, further comprising:

a cover portion covering a lower surface of the holding frame, the cover portion being formed of a material with a lower thermal conductivity than the material of the channel structure.

4. The liquid ejection head according to claim 3, wherein the cover portion is formed of a resin film.

5. The liquid ejection head according to claim 1, further comprising:

a vibration plate;

a plurality of first piezoelectric elements;

a plurality of second piezoelectric elements;

a flexible board;

an electrical connection portion having a plurality of contact points; and a temperature sensor, wherein the nozzles include:

a plurality of first nozzles forming a first nozzle row in another direction orthogonal to the width direction and the stacking direction; and a plurality of second nozzles forming a second nozzle row in the other direction;

wherein the liquid ejection channel of the channel structure includes a first liquid ejection channel and a second liquid ejection channel, wherein the first liquid ejection channel includes a plurality of first pressure chambers each communicating with a corresponding one of the first nozzles, wherein the second liquid ejection channel includes a plurality of second pressure chambers each communicating with a corresponding one of the second nozzles, wherein the vibration plate is located on an upper surface of the channel structure and defines upper ends of the first pressure chambers and the second pressure chambers, wherein each of the first piezoelectric elements is located, on an upper surface of the vibration plate, in association with a corresponding one of the first pressure chambers, wherein each of the second piezoelectric elements is located, on the upper surface of the vibration plate, in association with a corresponding one of the second pressure chambers, wherein the electrical connection portion is elongated in the other direction, wherein the contact points of the electrical connection portion are aligned in the other direction and located between the first piezoelectric elements and the second piezoelectric elements in the width direction, and electrically connect the first piezoelectric elements and the second piezoelectric elements to the flexible board, and wherein the temperature sensor is located at one end of the electrical connection portion in the other direction.

6. The liquid ejection head according to claim 5, further comprising:

a first sealing board surrounding and sealing the first piezoelectric elements; and a second sealing board surrounding and sealing the second piezoelectric elements, wherein the flexible board is disposed in a gap between the first sealing board and the second sealing board, wherein, in a plan view from the nozzle surface in the stacking direction, the gap is defined by side surfaces of the first sealing board and the second sealing board, and wherein each of a plurality of side surfaces, near the gap, of the supply channel structure covering the first sealing board and the second sealing board, is flush with a respective one of the side surfaces of the first sealing board and the second sealing board defining the gap.

7. The liquid ejection head according to claim 6, further comprising a potting material disposed in the gap.

8. The liquid ejection head according to claim 7, wherein the potting material includes an adhesive agent having a lower thermal conductivity than materials of the first sealing board and the second sealing board, and the material of the channel structure.

9. The liquid ejection head according to claim 1, wherein the liquid ejection channel of the channel structure includes:

a plurality of individual channels each provided for a corresponding one of the nozzles; and a manifold communicating with each of the individual channels, wherein the channel structure has an outer wall portion defining the manifold, the outer wall portion of the channel structure being covered by and contacting the covering portion of the supply channel structure, and wherein, when the liquid ejection head is viewed in another direction orthogonal to the width direction and the stacking direction, a thickness dimension of the covering portion is greater than a thickness dimension of the outer wall portion of the channel structure.

10. The liquid ejection head according to claim 1, wherein the liquid ejection channel of the channel structure includes:

a plurality of individual channels each provided for a corresponding one of the nozzles; and a manifold communicating with each of the individual channels, wherein, in a plan view from the nozzle surface, the manifold has a main portion elongated in another direction orthogonal to the width direction and the stacking direction, and a narrow portion narrower than the main portion in the width direction, and wherein, in the plan view, the channel structure has a first gap in an area from a position where the narrow portion is defined toward an end of the channel structure in the width direction.

11. The liquid ejection head according to claim 10, wherein the first gap is filled with a resin member.

12. The liquid ejection head according to claim 11, wherein the supply channel structure has the resin member filled in the first gap, the resin member protruding downward at a position corresponding to the first gap.

13. The liquid ejection head according to claim 11, wherein the supply channel structure is formed of a resin, and wherein the resin member filled in the first gap is formed of a resin different from the resin of the supply channel structure.

14. The liquid ejection head according to claim 10, wherein the narrow portion is located in an end portion of the main portion elongated in the other direction, wherein, in the plan view from the nozzle surface, the narrow portion tapers toward an end of the manifold in the other direction, and wherein the first gap is provided in the area of the channel structure from the position where the narrow portion having a tapered shape is defined toward the end of the channel structure in the width direction.

15. The liquid ejection head according to claim 14, wherein the first gap is provided at a position overlapping with the end portion of the main portion when viewed in the width direction.

16. The liquid ejection head according to claim 10, wherein the channel structure has a first boundary portion that separates the manifold and the first gap by a specified distance.

17. The liquid ejection head according to claim 16, wherein, in the plan view from the nozzle surface, the channel structure has a second gap in each of end areas outside of a row of the nozzles in the other direction.

18. The liquid ejection head according to claim 17, wherein, in the plan view from the nozzle surface, the channel structure has a second boundary portion that separates the second gap and each of the end areas outside the row of the nozzles by a specified distance.

19. The liquid ejection head according to claim 18, wherein the channel structure has a first edge portion and a second edge portion, the first edge portion defining the first gap together with the first boundary portion, the second edge portion defining the second gap together with the second boundary portion.

20. The liquid ejection head according to claim 1, wherein the main portion of the supply channel structure contacts at least a portion of a sealing board surrounding one of: first piezoelectric elements and second piezoelectric elements.

21. The liquid ejection head according to claim 20, wherein the main portion of the supply channel structure contacts at least a portion of a vibration plate.

* * * * *